United States Patent [19]

Linnerz et al.

[11] 4,056,232

[45] Nov. 1, 1977

[54] PROTECTIVE DEVICE FOR ROTARY HAMMER BREAKER

[75] Inventors: Wilhelm Linnerz, Buttgen near Neuss; Josef Tillmanns, Dusseldorf, both of Germany

[73] Assignee: Lindemann Maschinenfabrik GmbH, Dusseldorf, Germany

[21] Appl. No.: 666,910

[22] Filed: Mar. 15, 1976

[30] Foreign Application Priority Data

Mar. 17, 1975 United Kingdom ..... 11052/75

[51] Int. Cl.[2] ..... B02C 13/04

[52] U.S. Cl. ..... 241/194

[58] Field of Search ..... 241/189 R, 189 A, 191, 241/193, 194, 197

[56] References Cited

U.S. PATENT DOCUMENTS

| | | | |
|---|---|---|---|
| 3,058,676 | 10/1962 | Hermann | 241/189 A UX |
| 3,380,672 | 4/1968 | Weispfenning | 241/191 X |
| 3,482,788 | 12/1969 | Newell | 241/189 R X |
| 3,727,848 | 4/1973 | Francis | 241/194 |
| 3,844,494 | 10/1974 | Hightower | 241/197 |

*Primary Examiner*—Roy Lake
*Assistant Examiner*—Howard N. Goldberg
*Attorney, Agent, or Firm*—Toren, McGeady and Stanger

[57] ABSTRACT

A rotary hammerbreaker including a plurality of discs driven upon a rotor shaft, a plurality of rods extending through the discs parallel to the rotor shaft and radially spaced therefrom and a plurality of hammers pivotably mounted upon the rods between the discs. The hammerbreaker is provided with a protective device consisting of a plurality of shields each including a hub mounted upon one of the rods between adjacent discs. The shields are formed with a circular segmental flange fixed to the hub extending over a part of the periphery of each of the adjacent discs between which the hub is mounted to protect the disc periphery. The flange has a circumferentially extending portion which is an integral fraction of a whole circle so that a number of the shields can be fitted to a rotary hammerbreaker to provide substantially continuous protection around the periphery of the discs.

10 Claims, 3 Drawing Figures

1
2
3
4
5
6
8
9
11
13
14
15
16
18
19
20
21
II
II

PROTECTIVE DEVICE FOR ROTARY HAMMER BREAKER

BACKGROUND OF THE INVENTION

The invention relates generally to hammerbreakers and is particularly concerned with protective shields for the rotor of such hammerbreakers. The hammerbreaker rotor in connection with which the invention is described comprises a plurality of discs which are mounted on a shaft, with hammers being pivotably or rockably mounted between the discs on rods arranged eccentrically relative to the rotor shaft and which extend through the discs.

Hammerbreakers are conventionally used for the comminution or breaking-up of metallic or non-metallic materials or mixtures of metallic and non-metallic materials. Customarily hammerbreakers comprise a stationary casing or housing in which a rotor is rotatably mounted. Fixed to the inner side of the housing are one or more stationary impact blocks or anvils which cooperate with the hammers mounted on the rotor. The rotor is usually driven at high speed and has a plurality of rods or shafts spaced radially from and extending parallel to the rotor shaft. The hammers are freely pivotably mounted on these rods or shafts, and comminution or breakup of the material is effected by the coaction between the rotor hammers and the stationary anvil which is usually situated at the inlet for the material to the housing.

The rotor hammers are distributed around the periphery thereof in spaced relationship circumferentially and axially of the rotor. The rotor body consists of a plurality of discs rigidly connected with the rotor shaft. If the material to be comminuted consists entirely or partially of metal, the outer surfaces of the discs which collectively form the rotor body and between which the rotor hammers are pivotally mounted will be subjected to considerable wear and will thus become damaged by the impinging material. After a relatively short operating time, significant amounts of metal will be torn or ground from the circumference of the discs and the discs become no longer usable and must be replaced. In this connection it should be appreciated that from a practical viewpoint it is more economical if only the rotor hammers need to be produced from especially hard and high-quality material with steel of lesser quality being adaptable for use in other parts. This applies to the discs which form the rotor body and it thus would be particularly advantageous if the danger of wear or damage to the circumference of the discs could be significantly reduced or eliminated.

Accordingly, it is the aim of the present invention to provide protection for the edges of the discs in a hammerbreaker rotor of the kind comprising a series of discs mounted coaxially on a driving shaft and a number of hammers freely pivotally mounted between the discs on pivot shafts spaced radially from and extending parallel to the axis of rotation of the rotor.

SUMMARY OF THE INVENTION

According to the invention, there is provided a shield comprising a hub which is adapted to be mounted on a pivot shaft between two adjacent discs, and a circular segmental flange fixed to the hub adapted to extend over and protect a part of the periphery of each of the two discs between which the hub is mounted, the flange having a circumferential extent which is an integral fraction of a whole circle so that a number of the shields can be fitted to a rotor to provide substantially continuous protection around the peripheries of the discs.

The shields protect the edges of the discs from the fragmented material which is hurled about in the interior of the housing during operation of the hammerbreaker. The protective shields themselves are made of wear-resistant materials and they are arranged and mounted on the rotor in such a way that they can be replaced rapidly and easily. The peripheral surfaces of the discs are so well protected from the fragmented workpiece material that they need to be replaced only at long intervals.

The invention also includes a hammerbreaker rotor of the kind described fitted with a series of shields in accordance with the invention protecting substantially the whole of the periphery of each of the discs with gaps through which the hammers extend between the flanges of some of the adjacent shields.

The various features of novelty which characterize the invention are pointed out with particularity in the claims annexed to and forming a part of this disclosure. For a better understanding of the invention, its operating advantages and specific objects attained by its use, reference should be has to the accompanying drawings and descriptive matter in which there is illustrated and described a preferred embodiment of the invention.

DETAILED DESCRIPTION OF THE PREFERRED EMBODIMENT

Figure 1:
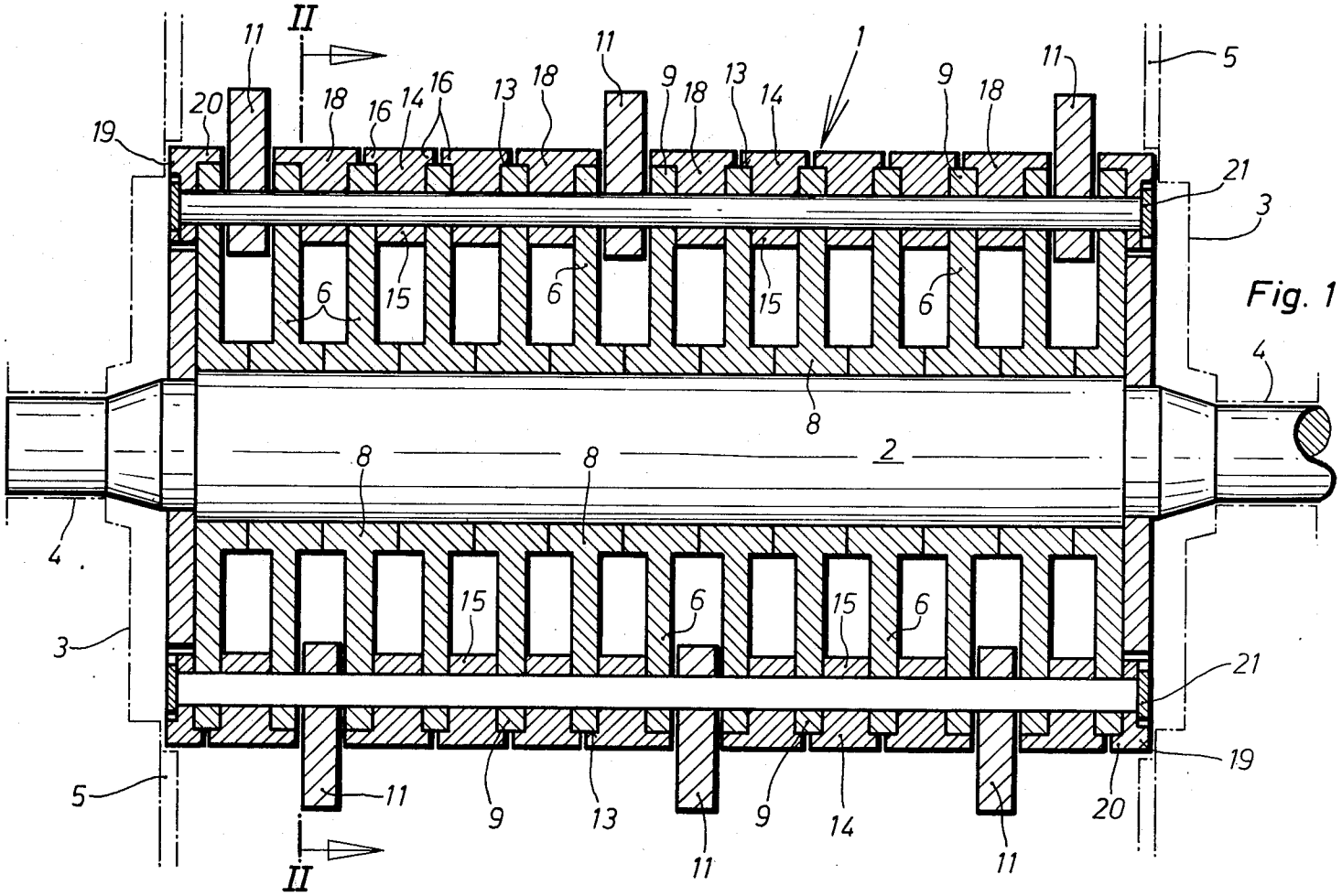
FIG. 1 is a longitudinal section through the rotor, the section being as seen in the direction of the arrows on the line I—I in FIG. 2.
Figure 2:
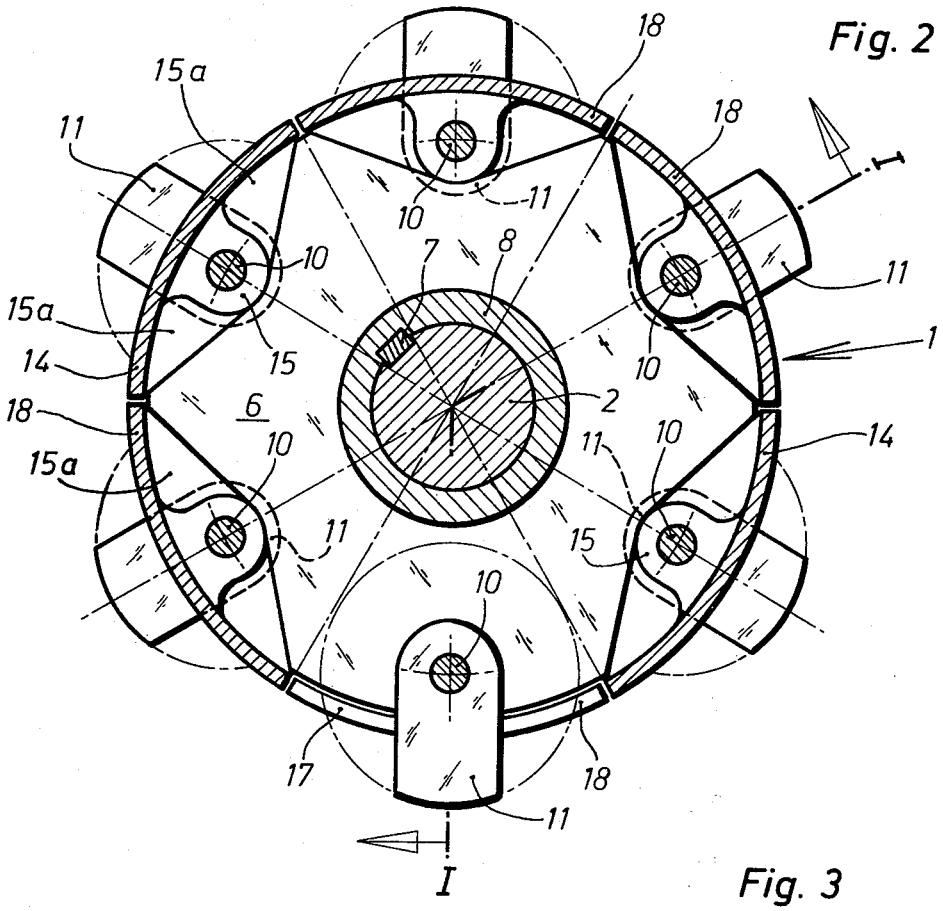
FIG. 2 is a cross section of the rotor as seen in the direction of the arrows on the line II—II in FiG. 1.

FIGS. 1 and 2 show a rotor 1 comprising a driving shaft 2 so that the rotor is rotatable in a housing of a hammerbreaker, the housing itself being merely indicated in part by dash-dot lines. Only end walls 3,5 and the bearings 4 of the housing are shown.

The rotor comprises a number of circular discs 6 keyed by a key 7 to the driving shaft 2, which, in use, is rotated rapidly by a power source (not shown). Each disc 6 has a hub part 8, the discs being mounted on the shaft 2 in close proximity with their hub parts 8 contacting each other. Each disc 6 includes a rim or peripheral part 9 with all of the discs 6 with their hub parts 8 together forming a body part of the rotor of the hammerbreaker.

Figure 3:
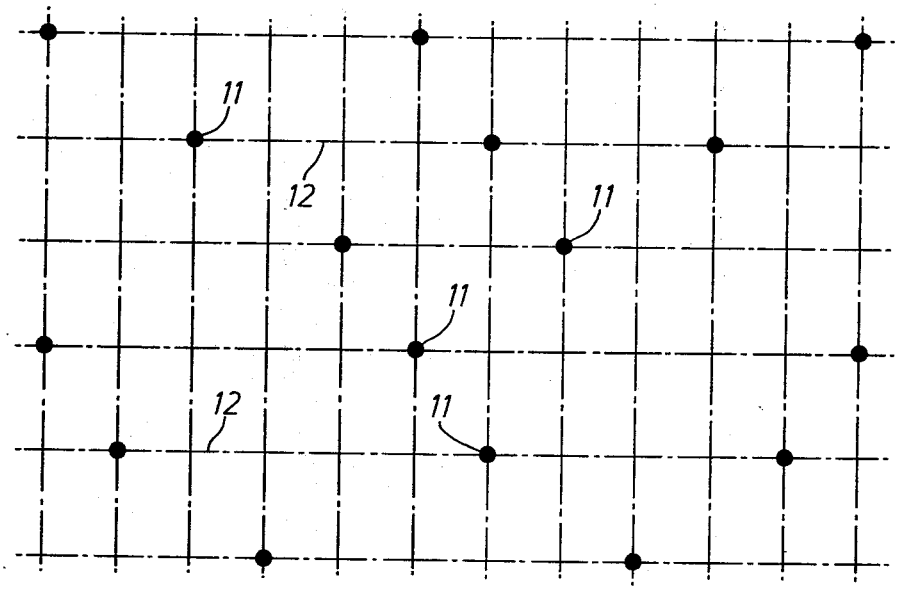
FIG. 3 is a diagram illustrating how the hammers are distributed in relation to the individual discs of the rotor.

A number of pivot rods or shafts 10, all located a radial distance from the driving shaft 2, pass through the discs 6 parallel to the axis of rotation of the rotor, that is parallel to the shaft 2 and support hammers 11. Each hammer pivots freely on its shaft 10. Each hammer is an eccentric body, with respect to the shaft 10, the head of the hammer projecting radially outwards beyond the periphery of the discs, as shown in FIG. 2. The heads of the hammers cooperate with stationary anvils (not shown) fixed to the inner surface of the hammerbreaker housing. The hammers and the anvils together break up the material in an annular space between the housing and the rotor. It will be observed that the hammers are not positioned close together in the axial direction. FIG. 3 depicts schematically how the hammers 11 are distributed on the shafts 10, here indicated by dash-dotted lines 12, in relation to the discs on the rotor. It should be noted that no two adjacent hammers 11 are arranged contiguous to each other. Rather the hammers 11 are distributed in the longitudinal direction of the rotor and along its circumference, as is clear from the diagram of FIG. 3. In FIG. 3 each of the large dots indicates the position of one of the hammers 11. Accordingly the dots are also identified by the reference numeral 11 while the dash-dotted lines 12 represent the shafts or rods 10.

The fact that the hammers are spaced apart from each other in the axial direction leaves, in conventional hammerbreakers, the peripheral edges 13 of the discs 6 exposed to abrasion and damage by the sharp-edged fragments of material hurled about in all directions in the hammerbreaker housing, outside the rotor, when the hammerbreaker is in operation. To prevent this kind of damage the hammerbreaker in accordance with the invention is equipped with shields 14 which include segmental flanges 16. Each shield has a hub 15 interposed between two neighboring discs 6, the hub being mounted on one or the rods 10. The outer segmental flanges 16 extend over the peripheral surfaces 13 of the discs 6, for protecting these surfaces from the destructive action of the workpiece fragments. The flanges 16 of the protective shields 14 are mounted very close together, that is to say the gaps between them are smaller than what could be conveniently represented in the drawing. Six of the flanges form a complete ring, but at those locations where a hammer projects outwards beyond the periphery of the rotor there are gaps 17 of the width of the hammer 11. In the example shown each hammer 11 takes the place of a shield 14 and adjacent to the hammers 11 there are provided shields 18 having a somewhat different configuration than the shields 14. The adjacent shields 18 have wider segmental flanges extending over the whole width of the edge of the disc adjacent the hammer. Apart from the gaps 17 the segments thus form an almost complete annular housing wall protecting the entire interior of the rotor from dirt. To give the shields 14 and 18 the necessary stiffness the hubs 15 have webs **15*a*. In FIG. 2 the webs 15*a* partly hide the disc 6**.

All the shields 14 and 18, respectively, are replicas of each other, except for the end-shields 19 which have only one flange 20 each, the shields 18 having the wider flanges adjacent the hammers. The end-shields 19 can as an alternative be formed as complete rings rather than in segments.

When the hammerbreaker is in operation only the shields 14, 18 and 19 suffer wear from the rapidly travelling fragments of workpiece material. Consequently, only these shields need to be replaced from time to time. To remove the shields from the hammerbreaker it is merely necessary to withdraw the shafts 10, after removing locking discs 21 which serve to retain the shafts 10 axially.

While a specific embodiment of the invention has been shown and described in detail to illustrate the application of the inventive principles, it will be understood that the invention may be embodied otherwise without departing from such principles.

What is claimed is:

1. A protective device for a rotary hammerbreaker including a plurality of discs secured upon a rotor shaft, a plurality of rods extending through said discs and hammers pivotably mounted upon said rods between said discs, said protective device comprising a plurality of shields each including a hub mounted upon one of said rods between adjacent discs, and a circumferential segmental flange fixed to said hub extending over at least a part of the periphery of at least one of the adjacent discs between which said hub is mounted to protect said part of said periphery, each of said segmental flanges being configured to extend over a portion of the circumference of said hammerbreaker with said plurality of shields being fitted to said rotary hammerbreaker such that said segmental flanges are juxtaposed relative to each other to provide substantially continuous protection over the periphery of said discs.

2. A protective device according to claim 1 including stiffening webs extending between said hub and the circumferential ends of said flange at each side of said hub.

3. A protective device according to claim 1 wherein said shields are fitted upon said rotary hammerbreaker to define between said shields a plurality of gaps through which said hammers extend between said flanges of some of said adjacent shields.

4. A protective device according to claim 1 wherein the majority of said plurality of shields each comprise a substantially identical configuration.

5. A protective device according to claim 1 wherein said plurality of shields includes adjacent shields located proximate said hammers, with the segmental flange of each of said adjacent shields located proximate said hammers extending contiguously relative to each hammer adjacent thereto.

6. A protective device according to claim 1 wherein some of the shields of said plurality of shields each have a segmental flange which extends an equivalent distance on either side of said hub taken in directions axially of said hammerbreaker.

7. A protective device according to claim 1 wherein some of the shields of said plurality of shields each have a segmental flange which extends unequal distances on either side of said hub taken in directions axially of said hammerbreaker.

8. A protective device according to claim 1 wherein some of the shields of said plurality of shields each have a segmental flange which extends to one side only of said hub taken in directions axially of said hammerbreaker.

9. A protective device according to claim 1 wherein some of the shields of said plurality of shields each have a generally T-shaped cross-sectional configuration taken in a plane extending radially of said hammerbreaker and generally centrally of said hub.

10. A protective device according to claim 1 wherein said segmental flanges are configured and arranged to define the outer surface of said hammerbreaker as a substantially continuous circular cylinder.

* * * * *